US010424839B2

(12) United States Patent
Li et al.

(10) Patent No.: US 10,424,839 B2
(45) Date of Patent: Sep. 24, 2019

(54) PHASE SHIFTER ASSEMBLY

(71) Applicant: CommScope Technologies LLC, Hickory, NC (US)

(72) Inventors: Yuemin Li, Suzhou (CN); Hangsheng Wen, Suzhou (CN); Haifeng Li, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/752,431

(22) PCT Filed: Aug. 25, 2016

(86) PCT No.: PCT/CN2016/096660

§ 371 (c)(1),
(2) Date: Feb. 13, 2018

(87) PCT Pub. No.: WO2017/036339

PCT Pub. Date: Mar. 9, 2017

(65) Prior Publication Data

US 2019/0013582 A1 Jan. 10, 2019

(30) Foreign Application Priority Data

Aug. 28, 2015 (CN) ..... 2015 1 0541028

(51) Int. Cl.
*H01P 1/18* (2006.01)
*H01Q 1/24* (2006.01)
*H01Q 3/32* (2006.01)

(52) U.S. Cl.
CPC ..... *H01Q 3/32* (2013.01); *H01P 1/184* (2013.01); *H01Q 1/246* (2013.01)

(58) Field of Classification Search
None
See application file for complete search history.

(56) References Cited

U.S. PATENT DOCUMENTS 4,451,831 A * 5/1984 Stangel ..... H01Q 3/242 342/374
7,345,625 B1 * 3/2008 Urkowitz ..... G01S 7/026 342/159

(Continued)

FOREIGN PATENT DOCUMENTS

CN 101615721 A 12/2009
CN 102683897 A 9/2012

(Continued)

OTHER PUBLICATIONS

International Search Report, International Application No. PCT/CN2016/096660, dated Nov. 11, 2016, 3 pp.

(Continued)

*Primary Examiner* — Howard Williams
(74) *Attorney, Agent, or Firm* — Myers Bigel, P.A.

(57) ABSTRACT

The present invention provides a phase shifter assembly for an array antenna, comprising: a first level phase shifter, wherein the first level phase shifter is configured to control the phases of a plurality of sub-arrays of the array antenna, where each sub-array comprises one or more radiating elements; a second level phase shifter, wherein the second level phase shifter is configured to proportionally change the phases of the radiating elements in the corresponding sub-arrays; and a power divider, wherein the power divider is connected between the first level phase shifter and the second level phase shifter. The phase shifter assembly has the advantages of both a distributed phase shifter network and a lumped phase shifter network. Specifically, the phase shifter assemblies can independently control the phases of the radiating elements in the array to obtain better sidelobe suppression. Further, phase control parts of the phase shifter are concentrated within a certain physical space range, so the size of the phase shifter assembly may be greatly decreased, (Continued)

and the cost may be greatly reduced, as compared with a conventional distributed phase shifter assembly design.

15 Claims, 8 Drawing Sheets

(56) References Cited

U.S. PATENT DOCUMENTS

| | | | | |
|---|---|---|---|---|
| 7,463,190 | B2 | 12/2008 | Zimmerman | |
| 8,674,787 | B2 | 3/2014 | Bradley et al. | |
| 8,674,788 | B2 | 3/2014 | Le | |
| 10,116,425 | B2 | 10/2018 | Zimmerman | |
| 2004/0085250 | A1 | 5/2004 | Tillery | |
| 2005/0248494 | A1 | 11/2005 | Davies | |
| 2008/0024385 | A1 | 1/2008 | Zimmerman | |
| 2008/0079640 | A1 | 4/2008 | Yang | |
| 2010/0214171 | A1* | 8/2010 | Quan | H01Q 1/28 342/374 |
| 2012/0098619 | A1* | 4/2012 | Oo | H01P 1/184 333/161 |
| 2013/0120206 | A1 | 5/2013 | Biancotto et al. | |
| 2014/0203967 | A1* | 7/2014 | Aydin | H01Q 3/267 342/372 |
| 2015/0098495 | A1 | 4/2015 | He et al. | |
| 2017/0179594 | A1* | 6/2017 | Liao | H01Q 3/32 |

FOREIGN PATENT DOCUMENTS

| | | | |
|---|---|---|---|
| CN | 102907168 | A | 1/2013 |
| EP | 1 178 563 | A1 | 2/2002 |
| EP | 2 221 924 | A2 | 8/2010 |
| WO | 2017036339 | | 3/2017 |

OTHER PUBLICATIONS

Written Opinion of the International Searching Authority, International Application No. PCT/CN2016/096660, dated Nov. 11, 2016, 3 pp.

* cited by examiner

PHASE SHIFTER ASSEMBLY

RELATED APPLICATIONS

This application is a 35 U.S.C. § 371 national stage application of PCT Application No. PCT/CN2016/096660, filed on Aug. 25, 2016, which claims priority from Chinese Application No. 201510541028.0 filed on Aug. 28, 2015, the contents of which are incorporated herein by reference in their entireties. The above-referenced PCT International Application was published in the English language as International Publication No. WO 2017/036339 A1 on Mar. 9, 2017.

FIELD OF THE INVENTION

The present invention generally relates to a phase shifter assembly for a base station array antenna.

BACKGROUND OF THE INVENTION

The current development of mobile communications changes with each passing day and has rapidly entered a 4G era from a 3G era, and the popularity rate of mobile phones is very high and is increasing year by year. Moreover, with the increasing complexity of geographical and electromagnetic application environments, the requirements on the cost of a base station antenna and on such performance indexes as high gain, low sidelobe and the like are also steadily increasing. Base station antennas are typically implemented as phased array antennas that have a plurality of individual radiating elements that are disposed in one or more columns.

In order to change the coverage of the base station antenna, a mobile operator usually changes the elevation or "tilt" angle of the base station antenna. Currently, a mainstream base station antenna is mostly an electrically tunable antenna with an electrically adjustable tilt angle. The introduction of antennas having electrically adjustable tilt angles provides convenience for an operator, since the tilt angle of the antenna can be adjusted without the need for a technician to climb an antenna tower and mechanically adjust the tilt angle. As a result, the safety of the operator can be guaranteed, the workload is reduced, and the work efficiency is improved.

The tilt angle of a base station antenna is typically (but not always) set to an angle of less than 0 degrees with respect to the horizon, and hence the tilt angle of a base station antenna is often referred to as the "downtilt" angle. The downtilt angle of the antenna is set to not only reduce the neighborhood interference of a cellular network and effectively control the coverage of a base station and the soft switch proportion of the network, but also is set to enhance the signal intensity within the coverage of the base station, so as to improve the communication quality of the entire network.

A phase shifter can achieve beamforming of an array antenna, can enable the downtilt angle of the antenna to be continuously adjustable, is an important part of the electrically tunable antenna of the base station, and plays a critical role in adjusting the tilt angle, suppressing sidelobe and obtaining a high gain and the like.

FIG. 1. shows a vertical plane directional diagram of a conventional base station antenna with a 0-degree tilt angle. The sidelobe suppression performance of the antenna is focused on herein.

FIG. 2 is a schematic diagram illustrating a phased array base station antenna having five radiating elements. FIG. 2 further illustrates changing the phases of the individual radiating elements in an array antenna to electrically adjust the tilt angle of the antenna. As known by those of ordinary skill in the art, conventional base station antennas typically include one or more of the arrays of radiating elements such as the array shown in FIG. 2. In order to achieve a variable electric tilt angle, the phases of the radio frequency ("RF") signals transmitted or received through the antenna units (also referred to interchangeably herein as "radiating elements") in the array antenna need to be changed, thus allowing the phases of the RF signals at the radiating elements to have a relationship similar to an arithmetic progression. Additionally, in order to obtain better sidelobe suppression, there are also certain requirements on the amplitudes of the RF signals fed through each radiating element. The binomial amplitude distribution of an array antenna having five radiating elements that is shown in FIG. 3 is a common amplitude distribution form that may be used to provide sidelobe suppression. Of course, many other kinds of amplitude distribution forms are also known.

As mentioned above, the phase change and the function of providing a certain form of amplitude distribution are usually achieved by a phase shifter network. Conventional phase shifter networks are generally divided into two types: a. distributed phase shifter networks (as shown in FIG. 4); and b. lumped phase shifter networks (as shown in FIG. 5).

a. Distributed Phase Shifter Network

As shown in FIG. 4, the so-called distributed phase shifter network individually controls the phases of each of the radiating elements in the array antenna by a phase shifter system.

The advantages of this structure lies in that each antenna oscillator (which term is used interchangeably herein with the terms "antenna unit" and "radiating element") in the array has independent phase control, so a nearly perfect vertical plane directional diagram can be obtained, and very good sidelobe suppression can be achieved at each downtilt angle.

The disadvantages of this structure are it requires a greater number of individual phase shifters (namely one for each radiating element) resulting in a large size and an increased cost for the phase shifter system.

b. Lumped Phase Shifter Network

As shown in FIG. 5, in the so-called lumped phase shifter network the phases of a plurality of sub-arrays of radiating elements in the array antenna are controlled by the phase shifter system, and the radiating elements in each sub-array are connected by a power divider. However, the phase differences (if any) between the radiating elements in each sub-array are constant and invariable.

The advantages of this structure lie in that the phase shifter system is small in size and low in cost.

The disadvantages of this structure lie in that as the phases of all of the radiating elements in the array cannot be independently controlled, and hence the sidelobe suppression may be worse.

In addition, the existing multi-port phase shifter generally adopts a serial form, and a level of phase shift error will be superimposed once a level of phase shifter is additionally connected in series, such that when the phase shifter is connected to the array antenna, the phase error of output ports of the phase shifters on both ends may be larger, and the phase error of each radiating element in the array antenna may be inconsistent.

SUMMARY OF THE INVENTION

In view of the aforementioned disadvantages in the prior art, embodiments of the present invention provide phase shifter assemblies for base station array antennas which may have the advantages of both a distributed phase shifter network and a lumped phase shifter network. Specifically, the phase shifter assemblies according to embodiments of the present invention can independently control the phases of the radiating elements in the array to obtain better sidelobe suppression. Further, phase control parts of the phase shifter are concentrated within a certain physical space range, so the size of the phase shifter assembly may be greatly decreased, and the cost may be greatly reduced, as compared with a conventional distributed phase shifter assembly design.

To solve the aforementioned technical problems, the present invention provides a phase shifter assembly. The phase shifter assembly includes: a first level phase shifter, wherein the first level phase shifter is used for controlling the phases of a plurality of sub-arrays in an array antenna, and each sub-array includes one or more radiating elements; a second level phase shifter, wherein the second level phase shifter is used for proportionally changing the phases of the radiating elements in the corresponding sub-arrays, when the first level phase shifter changes the phases of the sub-arrays; and a power divider, wherein the power divider is connected between the first level phase shifter and the second level phase shifter.

Preferably, the first level phase shifter is used for achieving the power allocation of dividing one into M, and the power divider and the second level phase shifter are used for achieving the power allocation of dividing one into N, so the phase shifter assembly can achieve the power allocation of dividing one into M*N, wherein M and N are both integers larger than 1.

The design solution of two levels of phase shifters are adopted in the phase shifter assembly according to embodiments of the present invention, wherein the first level phase shifter is a typical lumped design and can control the phases of a plurality of sub-arrays; and the second level phase shifter can be any phase shifter that can change the phases of individual radiating elements. Therefore, the same functions as the distributed phase shifter network can be achieved.

In some embodiments, the power divider may be a Wilkinson power divider. The use of Wilkinson power dividers may reduce the reflection effects caused by the matching problem between the ports of the phase shifter, provide higher linearity for the phases in the entire transmission link, and also provide improved smoothness for the amplitudes, which may be conducive to improving the forming effect of a directional diagram of the array antenna.

Preferably, the first level phase shifter includes one or more levels of sub-phase shifters, wherein each level of sub-phase shifter of the first level phase shifter is used for controlling the phases of one or more sub-arrays in the array antenna.

Preferably, the second level phase shifter includes one or more levels of sub-phase shifters, wherein each level of sub-phase shifter of the second level phase shifter is used for proportionally changing the phases of the individual radiating elements in the corresponding antenna groups, when the first level phase shifter changes the phases of the sub-arrays.

Therefore, the phase shifter assembly according to embodiments of the present invention can provide different amplitudes and phases for the output ports to feed back independent amplitudes and phases to each radiating element in the array antenna. By adopting the phase shifter assembly according to the present invention, standard Chebyshev, Taylor and binomial distribution of the array antenna can be achieved within the range of the entire downtilt angle, and the vertical plane directional diagram of the array antenna has a good forming effect, so as to meet the requirements of low sidelobe and high gain. Moreover, on the premise of supporting transmission expansion, graded phase shift can be expanded at any output port again to meet the demands of the array antennas with different numbers of radiating elements.

In some embodiments, the first level phase shifter, the second level phase shifter and/or the power divider may be integrated on one printed circuit board ("PCB"). Therefore, the overall size of the phase shifter assembly can be greatly reduced.

In some embodiments, the ports in the phase shifter assembly may be disposed in parallel. Therefore, superposition of phase shift error of each level may be eliminated, and thus the ports achieve may achieve more accurate phase linearity.

In some embodiments, the first level phase shifter, the second level phase shifter and/or the power divider may be connected by a cable, a microstrip line or other transmission cable, and the second level phase shifter may be connected to an associated radiating element by a cable.

BRIEF DESCRIPTION OF THE DRAWINGS

Various objects, features and advantages of the present invention will become more apparent by considering the following detailed description of example embodiments of the present invention in combination with accompany drawings. The accompany drawings are merely exemplary diagrams of embodiments of the present invention, and are not necessarily drawn to scale. In the accompanying drawings, identical reference signs consistently represent identical or similar components.

DETAILED DESCRIPTION OF THE EMBODIMENTS

Example embodiments of phase shifter assemblies according to the present invention will be introduced below with reference to the accompany drawings. The illustrated contents and the accompany drawings are merely exemplary in essence, and are not intended to limit the protection scope of the appended claims in any way.

Figure 1:
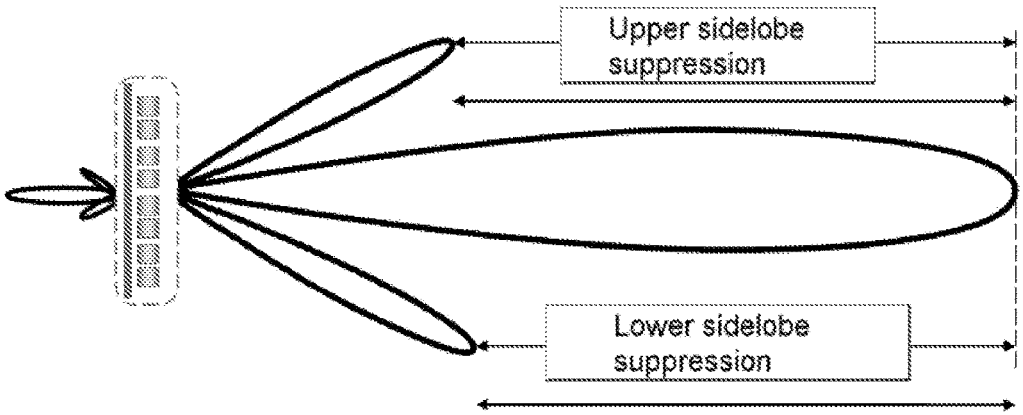
FIG. 1 is a vertical plane directional diagram of a conventional base station antenna with a 0-degree tilt angle.
Figure 2:
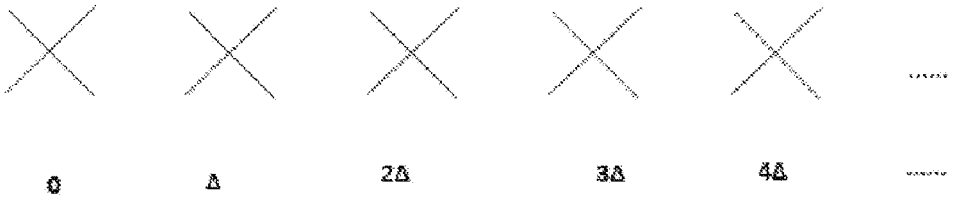
FIG. 2 is a schematic diagram illustrating a phase progression that may be applied to the radiating elements of an array antenna to adjust an electric tilt angle of the antenna.
Figure 3:
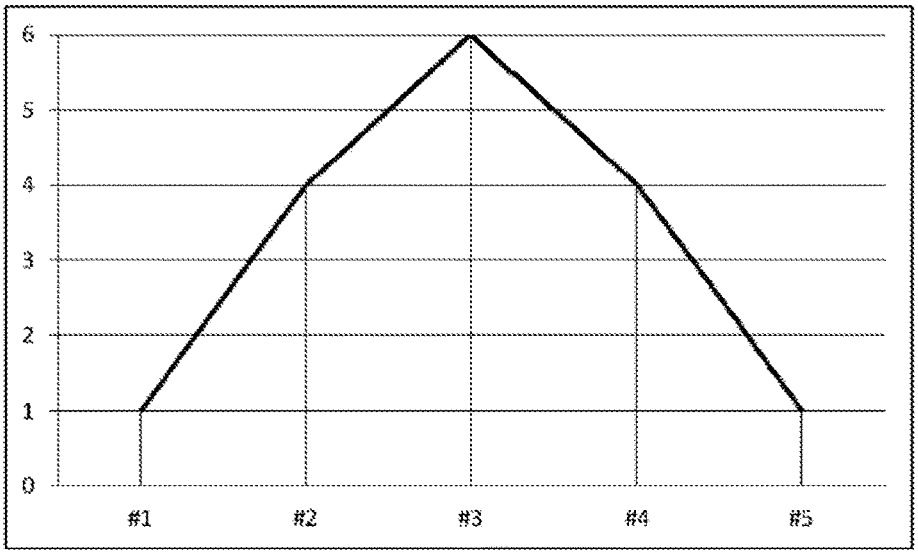
FIG. 3 is a schematic diagram of binomial amplitude distribution that may be applied to the five radiating elements (or sub-arrays of radiating elements) of an array antenna.
Figure 4:
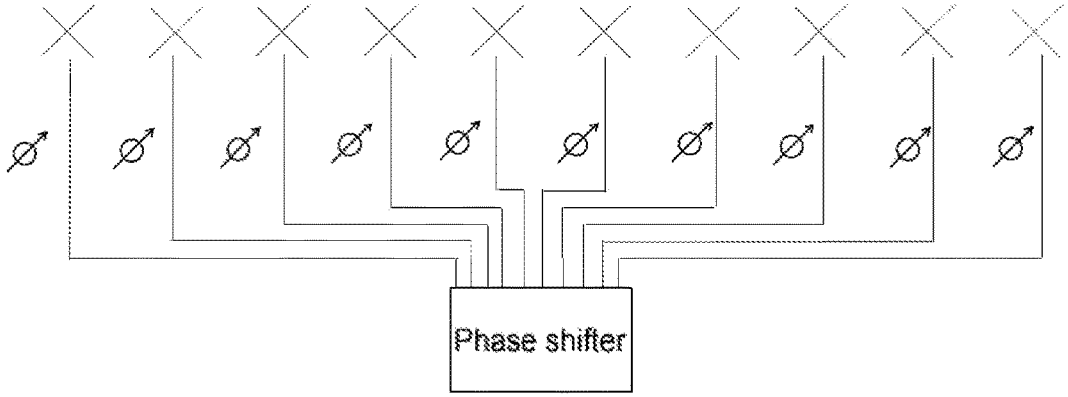
FIG. 4 is a schematic diagram of a distributed phase shifter network.
Figure 5:
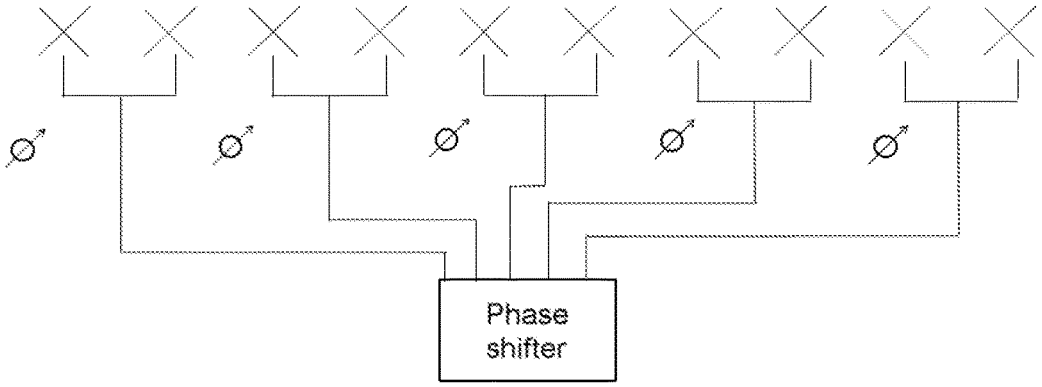
FIG. 5 is a schematic diagram of a lumped phase shifter network.
Figure 6:
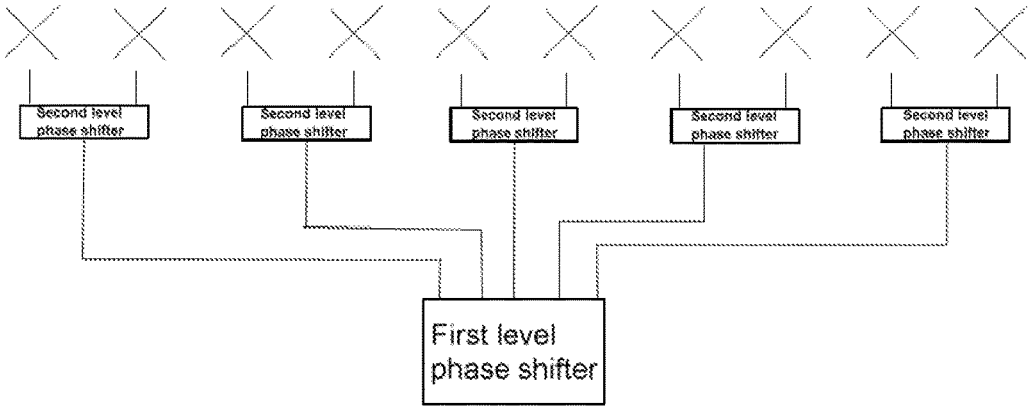
FIG. 6 is a schematic diagram of a phase shifter assembly according to embodiments of the present invention.

FIG. 6 is a schematic diagram of a phase shifter assembly for a base station array antenna according to embodiments of the present invention. As shown in FIG. 6, the phase shifter assembly includes two levels of phase shifters, so it can have the advantages of both of a distributed phase shifter network and a lumped phase shifter network. Specifically, the phase shifter assembly can independently control the phases of the radiating elements in the array to obtain better sidelobe suppression. Further, phase control parts of the phase shifter are concentrated within a certain physical space range, so the size of the phase shifter assembly may be greatly decreased, and the cost may be greatly reduced, as compared with a distributed design.

As shown in FIG. 6, the phase shifter assembly includes: a first level phase shifter, wherein the first level phase shifter is configured to control the phases of a plurality of sub-arrays in an array antenna, and each sub-array includes one or more radiating elements; a second level phase shifter, wherein the second level phase shifter is used for proportionally changing the phases of the radiating elements in the corresponding sub-arrays, when the first level phase shifter changes the phases of the sub-arrays; and a power divider, wherein the power divider is connected between the first level phase shifter and the second level phase shifter. In this case, the first level phase shifter may be used for achieving the power allocation of dividing one into M, and the power divider and the second level phase shifter may be used for achieving the power allocation of dividing one into N, so the phase shifter assembly can achieve the power allocation of dividing one into M*N, wherein M and N are both integers larger than 1. In the phase shifter assembly, the first level phase shifter may be a typical lumped design and can control the phases of a plurality of sub-arrays; and the second level phase shifter can be any phase shifter that can change the phases of the radiating elements. Therefore, the same functions as the distributed phase shifter network can be achieved.

First Embodiment

Figure 7:
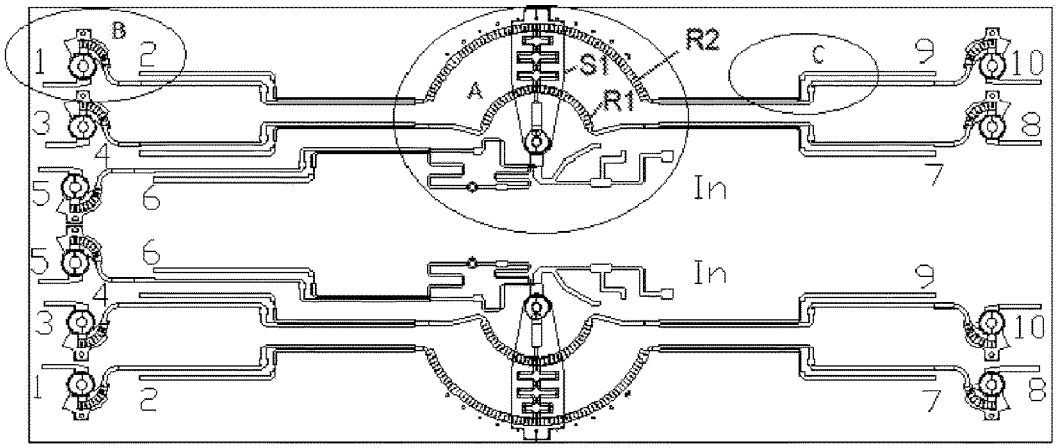
FIG. 7 is a plan view of a first embodiment of a phase shifter assembly according to the present invention.
Figure 8:
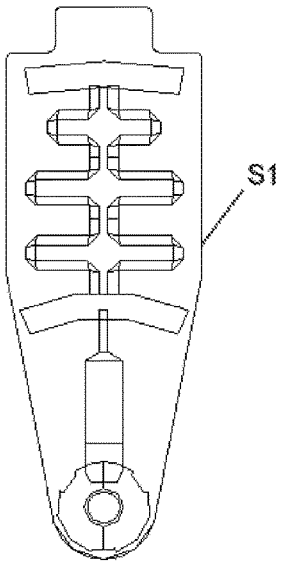
FIG. 8 is a schematic diagram of a rotatable wiper arm of a first level phase shifter that is included in the phase shifter assembly of FIG. 7.
Figure 9:
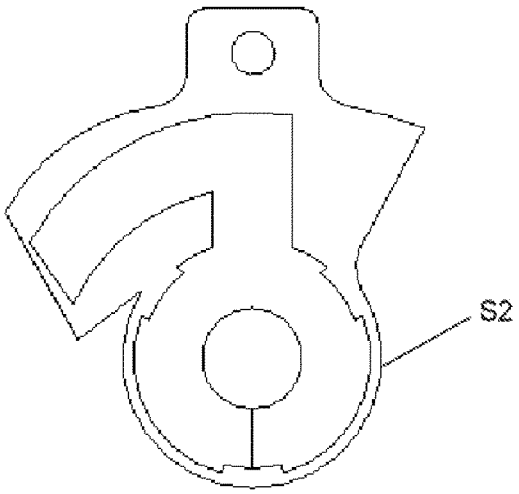
FIG. 9 is a schematic diagram of a rotatable wiper arm of a second level phase shifter that is included in the phase shifter assembly of FIG. 7.

FIGS. 7 to 9 illustrate a first embodiment of a phase shifter assembly according to the present invention. As shown in FIG. 7, the first level phase shifter is located in an Area A, two arc members R1 and R2 are in coupled connection by a rotatable wiper arm S1 (reference can be specifically made to FIG. 8), and the phases are changed by sliding of the rotatable wiper arm S1 on the arc members R1 and R2.

As shown in FIG. 7, the second level phase shifter is located in an area B and also adopts a combined structure of a rotatable wiper arm S2 (reference can be specifically made to FIG. 9) and the arc member, but only one arc member is provided, and the phase between two connected ports is changed by sliding of the rotatable wiper arm S2 on the arc member.

As shown in FIG. 7, a Wilkinson power divider is located in an area C, the Wilkinson power divider can be an unequal power divider or an equal power divider, and the isolation of two ports can be improved by adding a resistor so as to further improve the directional diagram. Other types of power dividers may be used in other embodiments.

As shown in FIG. 7, the Wilkinson power divider is connected between the first level phase shifter and the second level phase shifter, and the first level phase shifter, the Wilkinson power divider and the second level phase shifter can be integrated on one PCB. Therefore, the overall size of the phase shifter assembly can be greatly reduced. The port of the first level phase shifter labelled "In" in FIG. 7 is an energy input port. The first level phase shifter achieves the power allocation of energy of dividing one into five (i.e., M=5) and changes the phases through the rotatable wiper arm, and secondary power allocation of the energy of is performed by the Wilkinson power divider which divides the signal on each output port of the first level phase shifter in two (i.e., N=2). The second level phase shifters perform secondary phase shifts on each branch. Therefore, the power allocation of dividing one into ten (i.e., M*N=10) can be achieved. As shown in FIG. 7, the energy is input at the energy input port In and is divided and transmitted to ten output ports (i.e., signs 1-10 in the figure) by two different levels of power allocation, and the ten output ports are respectively connected to corresponding radiating elements.

FIG. 8 is a plan view of the rotatable wiper arm S1 of the first level phase shifter. The rotatable wiper arm S1 includes a circuit layer that is coupled to a circuit layer on the PCB to achieve coupling of the RF energy from the PCB to the rotatable wiper arm S1 The RE energy is then coupled from the rotatable wiper arm S1 back to the PCB along the arcs R1, R2. The first level phase shifter can include one or more levels of sub-phase shifters, wherein each level of sub-phase shifter of the first level phase shifter is used for controlling the phases of one or more of the sub-arrays in the array antenna.

FIG. 9 shows the rotatable wiper arm S2 of the second level phase shifter, the rotatable wiper arm S2 is placed on one of two branches divided from the Wilkinson power divider, and the movement of the phase is achieved by sliding of the rotatable wiper arm S2 on the arc member. The second level phase shifter can also include one or more levels of sub-phase shifters, wherein each level of sub-phase shifter of the second level phase shifter is used for proportionally changing the phases of the radiating elements in the corresponding sub-arrays, when the first level phase shifter changes the phases of the sub-arrays.

Therefore, the phase shifter assembly according to embodiments of the present invention can provide any different amplitudes and phases for the output ports to feed back independent amplitudes and phases to each radiating element in the array antenna. By adopting the phase shifter assembly according to embodiments of the present invention, standard Chebyshev, Taylor and directional diagram product equation distribution of the array antenna can be achieved within the range of the entire downtilt angle, and the vertical plane directional diagram of the array antenna may have a good forming effect, so as to meet the requirements of low sidelobe and high gain. Moreover, on the premise of supporting transmission expansion, graded phase shift can be expanded at any output port again to meet the demands of the array antennas with different numbers of radiating elements.

The ports in the phase shifter assembly may be arranged in a parallel form. Therefore, superposition of phase shift error at each level may be eliminated, and thus the ports may achieve more accurate phase linearity.

In some embodiments, the first level phase shifter, the second level phase shifter and/or the power divider may be connected by a cable, a microstrip line or other transmission cable, and the second level phase shifter may be connected to the radiating elements by cables.

While in the phase shifter assembly of FIGS. 7-9 a power divider and a sub-phase shifter of the second level phase shifter is coupled to each output port of the first level phase shifter, it will be appreciated that this need not be the case. Thus, it will be appreciated that in other embodiments a power divider and/or sub-phase shifter of the second level phase shifter may only be coupled to some of the output ports of the first level phase shifter. For example, in an array antenna that only has nine radiating elements, the power divider and second level phase shifter attached to one of the five output ports of the first level phase shifter in the phase shifter assembly of FIGS. 7-9 could be omitted.

It will also be appreciated that the individual power dividers in the power divider circuit need always be implemented as two way power dividers. For example, in other embodiments, three-way, four-way or other power dividers may be used.

Second Embodiment

Figure 10:
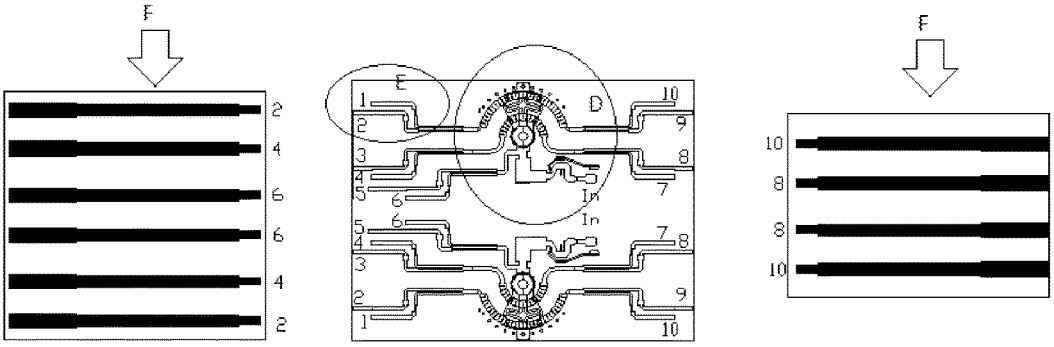
FIG. 10 is a schematic diagram of a second embodiment of a phase shifter assembly according to the present invention.
Figure 11:
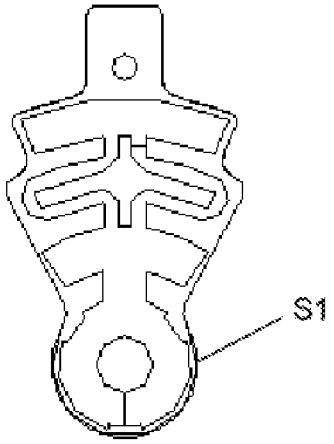
FIG. 11 is a schematic diagram of a rotatable wiper arm of a first level phase shifter that is included in the phase shifter assembly of FIG. 10.

FIGS. 10 to 11 illustrate a second embodiment of a phase shifter assembly according to the present invention. In the discussion that follows, the description of the second embodiment will focus on the features of the second embodiment, and same components as in the first embodiment are represented by the same reference signs in the first embodiment and will not be described below in detail.

As shown in FIG. 10, the first level phase shifter is located in an area D, two arc members are in coupled connection by a rotatable wiper arm S1 (reference can be specifically made to FIG. 11), and the phases are changed by sliding the rotatable wiper arm on the arc members.

As shown in FIG. 10, a Wilkinson power divider is located in an area E, the Wilkinson power divider can be an unequal power divider or an equal power divider, and the isolation of the two output ports of each Wilkinson power divider may be improved by adding a resistor so as to further improve the directional diagram.

As shown in FIG. 10, the second level phase shifter is located in an Area F, and the second level phase shifter adopts a medium phase shift structure, that is, the phases are changed by the change of the length of a medium covering a circuit.

As shown in FIG. 10, the first level phase shifter and the Wilkinson power divider are integrated on one PCB, the "In" port of the first level phase shifter is an energy input port, the first level phase shifter achieves the power allocation of energy of dividing one into five M=5) and moves the phases through the rotatable wiper arm, and each output port carries out secondary power allocation of the energy of dividing one into two N=2) through the Wilkinson power divider, so as to achieve the power allocation of dividing one into ten (i.e., M*N=10) and the first level phase shift.

The second level phase shifter adopting a medium phase shift structure is connected to one branch divided from the Wilkinson power divider to achieve secondary phase shift.

Reference numerals 1-10 in FIG. 10 represent ten output ports of the phase shifter assembly, and the ten output ports will be respectively connected to corresponding radiating elements of the antenna array. The first level phase shifter and the second level phase shifter are connected by a jumper wire.

FIG. 11 shows the rotatable wiper arm S1 of the first level phase shifter, a circuit layer is laminated to the circuit layer on the PCB to achieve the coupling of the energy, and act with the PCB on the bottom layer to achieve the power allocation of the energy of dividing one into five.

Figure 12:
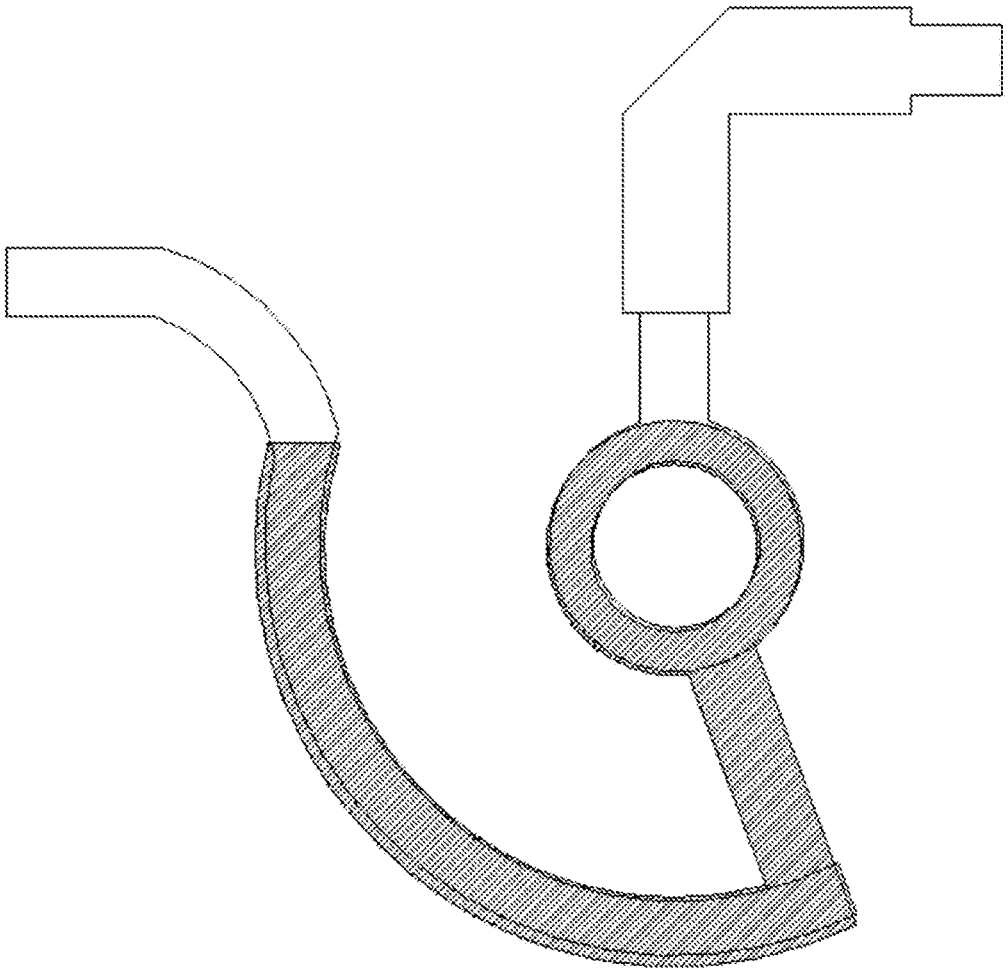
FIG. 12 is a schematic diagram of a second level phase shifter that can be used in the phase shifter assemblies according to embodiments of the present invention.

In addition, FIG. 12 shows a schematic diagram of a second level phase shifter that can be used in the phase shifter assemblies according to embodiments of the present invention. As shown in FIG. 12, the second level phase shifter is a sickle-shaped phase shifter, which achieves the movement of the phase by the arc sliding of the rotatable wiper arm. The sickle-shaped second level phase shifter can provide a larger sliding distance for the same phase shift amount requirement, so as to achieve a higher phase shift precision.

Figure 13:
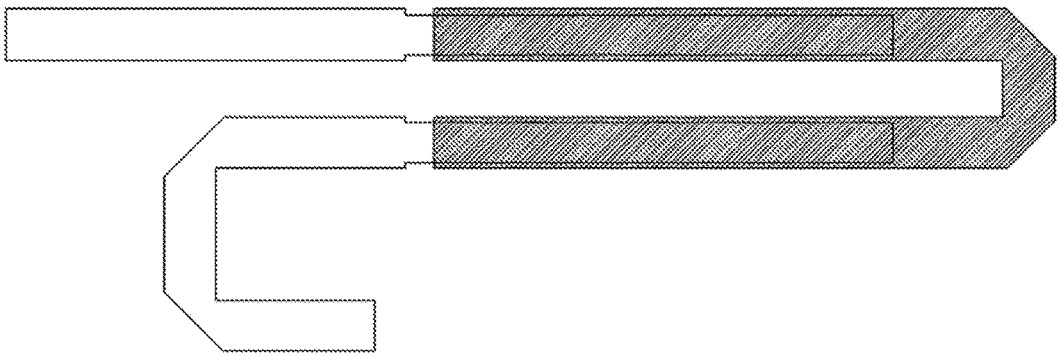
FIG. 13 is a schematic diagram of another second level phase shifter that can be used in the phase shifter assemblies according to embodiments of the present invention.

FIG. 13 shows a schematic diagram of another second level phase shifter that can be used in the phase shifter assemblies according to embodiments of the present invention. As shown in FIG. 13, the second level phase shifter is a U-shaped phase shifter, which achieves the movement of the phase by the linear sliding of the slip sheet.

Further, those skilled in the art should understand that the second level phase shifter that can be used in the phase shifter assemblies according to embodiments of the present invention is not limited to the aforementioned sickle-shaped phase shifter or U-shaped phase shifter. The second level phase shifter can also be a medium phase shift type phase shifter, which achieves the movement of the phase by medium sliding. Moreover, the second level phase shifter can also be implemented by any combination of the sickle-shaped phase shifter, the U-shaped phase shifter and the medium phase shift type phase shifter, or any other appropriate phase shifter.

In summary, the advantages of the phase shifter assemblies for the base station array antenna according to embodiments of the present invention include, but are not limited to:

(1) the phase shifter assemblies can design any different amplitudes and phases for the output ports to feed back independent amplitudes and phases to each radiating element in the array antenna. With the phase shifter assemblies according to embodiments of the present invention, standard Chebyshev, Taylor and binomial distribution of the array antenna can be achieved within the range of the entire downtilt angle, and the vertical plane directional diagram of the array antenna has a good forming effect, so as to meet the requirements of low sidelobe and high gain;

(2) various levels of phase shift parts are integrated on one PCB, so the volume of the phase shifter assembly may be greatly reduced, and modular production of the phase shifter assembly can be achieved;

(3) the Wilkinson power divider is integrated as the outermost level of power division, therefore, the reflection effects caused by the matching problem between the ports of the phase shifter can be reduced, higher linearity can be guaranteed for the phases in the entire transmission link, and good smoothness may be achieved for the amplitudes, which is conducive to improving the forming effect of the directional diagram of the array antenna;

(4) the existing multi-port phase shifter generally adopts a serial form, and a level of phase shift error will be superimposed once a first level phase shifter is connected in series, such that the phase error of the output ports of the phase shifters on both ends in the antenna array connected with the phase shifter is larger, and the phase error of each radiating element in the antenna array may be inconsistent. However, the ports of the phase shifter assembly according to embodiments of the present invention all adopt the parallel form, and the error of each level is not superposed, so the ports can achieve more accurate phase linearity; and (5) on the premise of supporting transmission expansion, graded phase shift can be expanded at any output port again to meet the demands of the array antennas with different numbers of radiating elements.

Although the present invention has been disclosed with reference to some embodiments, various variations and modifications can be made to the embodiments without departing from the scope and range of the present invention. Accordingly, it should be understood that the present invention is not limited to the illustrated embodiments, and the protection scope of the present invention should be defined by the contents of the appended claims and the equivalent structures and solutions thereof.

The invention claimed is:

1. A phase shifter assembly for an array antenna, comprising:

a first level phase shifter, wherein the first level phase shifter is configured to control the phases of a plurality of sub-arrays of the array antenna, where each sub-array comprises one or more radiating elements;

a second level phase shifter, wherein the second level phase shifter is configured to proportionally change the phases of the radiating elements in the corresponding sub-arrays; and a power divider, wherein the power divider is connected between the first level phase shifter and the second level phase shifter, wherein the first level phase shifter comprises a plurality of sub-phase shifters, and each sub-phase shifter of the first level phase shifter is used for controlling the phases of one or more of the sub-arrays in the array antenna.

2. The phase shifter assembly of claim 1, wherein the first level phase shifter is used for achieving the power allocation of dividing one into M, and the power divider and the second level phase shifter are used for achieving the power allocation of dividing one into N, so the phase shifter assembly can achieve the power allocation of dividing one into M*N, wherein M is an integer larger than 2 and N is an integer larger than 1.

3. The phase shifter assembly of claim 1, wherein the power divider is a Wilkinson power divider.

4. The phase shifter assembly of claim 1, wherein the second level phase shifter comprises one or more levels of sub-phase shifters, and each level of sub-phase shifter of the second level phase shifter is used for proportionally changing the phases of the radiating elements in the corresponding sub-arrays.

5. The phase shifter assembly of claim 1, wherein the first level phase shifter, the second level phase shifter and/or the power divider are integrated on a single printed circuit board.

6. The phase shifter assembly of claim 1, wherein a plurality of ports in the phase shifter assembly are disposed in parallel.

7. The phase shifter assembly of claim 1, wherein the first level phase shifter, the second level phase shifter and/or the power divider are connected by a cable, a microstrip line or other transmission cable, and the second level phase shifter is connected to a radiating element by a cable.

8. The phase shifter assembly of claim 1, wherein the second level phase shifter is selected from a sickle-shaped phase shifter, a U-shaped phase shifter, a medium phase shift type phase shifter or any combination thereof.

9. A phase shifter assembly for an array antenna that includes a plurality of sub-arrays of radiating elements, the phase shifter assembly comprising:

a first level phase shifter having an input port and a plurality of output ports that each impart a different amount of phase shift to respective sub-components of a signal that is applied to the input port, each of the output ports coupled to a respective one of the sub-arrays; and a second level phase shifter that includes a plurality of sub-phase shifters, where each sub-phase shifter of the second level phase shifter is coupled between one of the output ports of the first level phase shifter and one of the radiating elements in a respective one of the sub-arrays.

10. The phase shifter assembly of claim 9, further comprising a power divider circuit that includes a plurality of power dividers, each of the power dividers coupled between a respective output port of the first level phase shifter and a respective one of the sub-arrays.

11. The phase shifter assembly of claim 9, wherein a sub-phase shifter of the second level phase shifter is coupled between the first level phase shifter and approximately half of the radiating elements.

12. The phase shifter assembly of claim 9, wherein the first level phase shifter and the second level phase shifter are implemented on a common printed circuit board.

13. The phase shifter assembly of claim 9, wherein each sub-phase shifter of the second level phase shifter is configured to change the phase for a respective single one of the radiating elements.

14. A phase shifter assembly for an array antenna that includes a plurality of sub-arrays of radiating elements, the phase shifter assembly comprising:

a first level phase shifter having an input port and a plurality of output ports, at least some of the output ports coupled to respective ones of a plurality of power dividers; and a second level phase shifter that includes a plurality of sub-phase shifters, wherein a first of the sub-phase shifters of the second level phase shifter is coupled between a first output port of a first of the plurality of power dividers and a first radiating element in a first of the sub-arrays of radiating elements, and a second output port of the first of the plurality of power dividers is coupled directly to a second radiating element in the first of the sub-arrays of radiating elements, and wherein a second of the sub-phase shifters of the second level phase shifter is coupled between a first output port of a second of the plurality of power dividers and a first radiating element in a second of the sub-arrays of radiating elements, and a second output port of the second of the plurality of power dividers is coupled directly to a second radiating element in the second of the sub-arrays of radiating elements.

15. The phase shifter assembly of claim 14, wherein the first level phase shifter is configured so that each of the plurality of output ports of the first level phase shifter impart a different amount of phase shift to respective sub-components of a signal that is applied to the input port of the first level phase shifter.

* * * * *